US008651041B2

(12) United States Patent
Myers

(10) Patent No.: US 8,651,041 B2
(45) Date of Patent: Feb. 18, 2014

(54) PERSONAL UNDERWATER VEHICLE

(76) Inventor: Michael Myers, Hollywood, FL (US)

( * ) Notice: Subject to any disclaimer, the term of this patent is extended or adjusted under 35 U.S.C. 154(b) by 82 days.

(21) Appl. No.: 13/466,073

(22) Filed: May 7, 2012

(65) Prior Publication Data

US 2013/0291781 A1 Nov. 7, 2013

(51) Int. Cl.
*B63C 11/46* (2006.01)

(52) U.S. Cl.
USPC ..... 114/315; D12/308

(58) Field of Classification Search
USPC ..... 114/315
See application file for complete search history.

(56) References Cited

U.S. PATENT DOCUMENTS

| | | | | | |
|---|---|---|---|---|---|
| 4,333,414 | A | * | 6/1982 | Hauz | 114/322 |
| 4,379,532 | A | * | 4/1983 | Dmitrowsky | 244/4 A |
| D288,344 | S | * | 2/1987 | Lau | D21/594 |
| 4,813,367 | A | | 3/1989 | Stevenson | |
| 4,864,959 | A | | 9/1989 | Takamizawa | |
| 4,996,938 | A | * | 3/1991 | Cameron et al. | 114/315 |
| D323,808 | S | | 2/1992 | DeSantis | |
| 5,105,753 | A | * | 4/1992 | Chih et al. | 114/315 |
| 5,158,034 | A | | 10/1992 | Hsu | |
| 5,303,666 | A | | 4/1994 | DeSantis | |
| 5,379,714 | A | * | 1/1995 | Lewis et al. | 114/315 |
| 5,423,278 | A | | 6/1995 | Lashman | |
| D416,225 | S | * | 11/1999 | Robinson et al. | D12/308 |
| 6,065,419 | A | * | 5/2000 | Stecker, Sr. | 114/315 |
| D447,109 | S | * | 8/2001 | Paoli et al. | D12/308 |
| D461,445 | S | * | 8/2002 | Nuytten et al. | D12/308 |
| 6,647,912 | B1 | | 11/2003 | Rogers | |
| 6,665,789 | B1 | * | 12/2003 | Stecker, Sr. | 114/315 |
| 6,748,894 | B1 | | 6/2004 | Dunn | |
| 6,976,445 | B1 | * | 12/2005 | Arneson | 114/315 |
| 7,000,559 | B2 | | 2/2006 | Mah | |
| 7,527,011 | B2 | | 5/2009 | Smith | |
| 2001/0025594 | A1 | | 10/2001 | Daniels | |
| 2008/0242162 | A1 | | 10/2008 | Smith | |

* cited by examiner

*Primary Examiner* — Lars A Olson
*Assistant Examiner* — Jovon Hayes
(74) *Attorney, Agent, or Firm* — Christopher J. Vandam, PA; Chris Vandam

(57) ABSTRACT

An underwater personal vehicle that as twin battery powered motors affixed to a central body. The propellers preferably counter-rotate and are in shrouds to allow true tracking without stabilizing fins. The operator holds onto the device and controls it from handles on the aft end of the central body. A light and supplemental ballast tubes are available. The thrust produced by the motors is at approximately the center of mass of the vehicle to further stabilize it during motion.

12 Claims, 5 Drawing Sheets

PERSONAL UNDERWATER VEHICLE

BACKGROUND OF THE INVENTION

1. Field of the Invention

The present invention relates to marine vehicles, and more particularly, to a personal underwater vehicle designed to tow a diver.

2. Description of the Related Art

Several designs for personal underwater vehicles have been designed in the past. None of them, however includes, among other features, a dual, counter rotating motor that pulls from near the center of mass while towing a diver from behind the center of mass and an adjustable ballast system and propeller-wash avoidance features combined into a sleek self-contained long range capable device.

Applicant believes that the closest reference corresponds to U.S. Pat. No. 4,996,938 issued to Cameron. However, it differs from the present invention because the Cameron device requires the operator of the device to grasp the device near the center of thrust, requires two-handed operation and requires the operator to expose their face, and necessarily their face mask, to the full force of the hydrodynamic water resistance during travel.

Furthermore, the present device includes features including an electronic display, accessory mounting rack, integrated light and is balanced to tow more than one person.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an underwater personal transportation device that has a long range, substantial depth penetration and is safely used by the operator.

It is another object of this invention to provide an underwater vehicle that is easy to transport, store, maintain and deploy.

It is still another object of the present invention to provide a device that can be used with a single hand, either for the handicapped or allowing the operator to have a hand freely available for other uses such as photography, spear fishing, navigation or to allow the operator diver to hold their nose for clearing sinuses and equalizing pressure.

It is another object of the present invention to provide an underwater vehicle that has an adaptable ballast system to accommodate varying power supplies and the mass of other onboard systems.

It is another object of the present invention to provide an underwater vehicle that is both thrust balanced and rider balanced so that the vehicle is easily steerable and controllable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
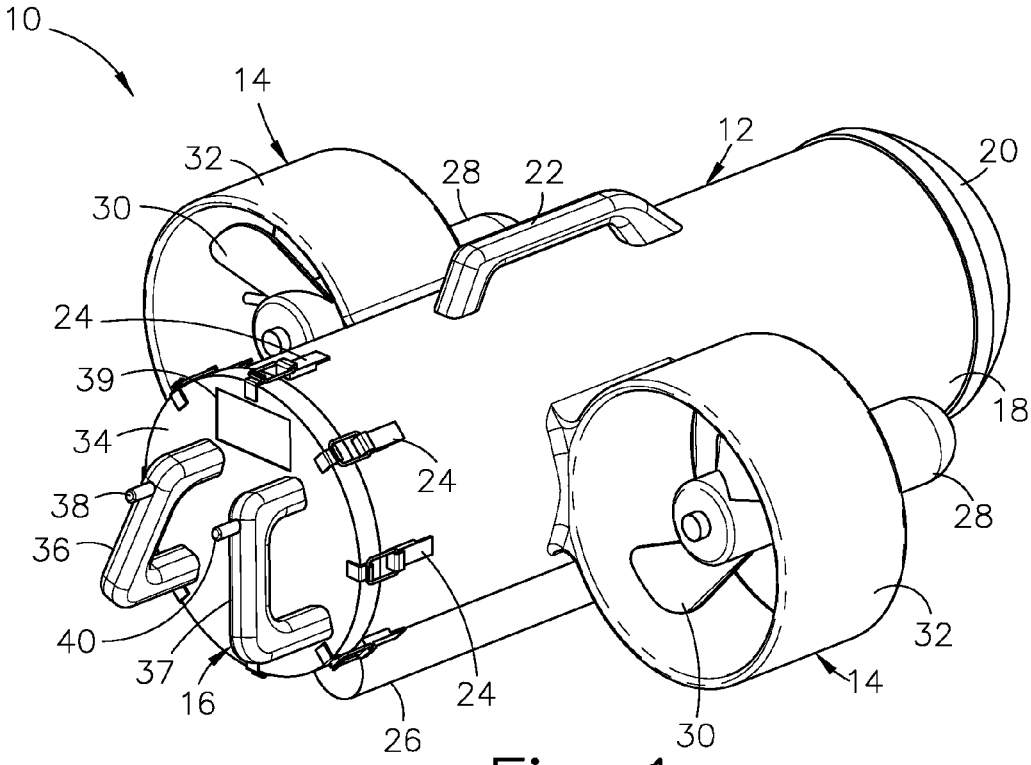
FIG. 1 represents a perspective view of the present invention.

It should be appreciated that the invention disclosed herein is sometimes equally referred to as the device, unit, system, vehicle or invention. Some components that would be readily apparent to one skilled in the art are not always shown in the drawings when sufficient enabling details are provided in this specification to allow for use and manufacture of the invention without undue experimentation.

Front and back, top and bottom, left and right and other descriptors are referenced as the device is shown in FIG. 1. The reading and interpretation of this document should be understood in light of these and other common sense constructions, as appropriate.

One version of the present invention is fairly characterized as an underwater motorized vehicle with twin motors. This unit is unique in many ways. First, the dual propeller thrust comes from either side of the diver and thus is not directly in her face mask. Also, the low profile of the unit allows it to be operated on the surface or beneath the water. The unit has been designed and engineered to speeds up to and beyond three miles per hour, depending on the diver and the charge of the battery.

Another feature is the speed control throttle 40. By depressing the throttle 40 button half way, the vehicle operates at half-speed which is an economical cruising rate. This propels the unit at approximately twelve pounds of thrust at which speed it can operate up to three hours of continuous use.

Depressing the accelerator button all the way puts the unit into high speed at maximum thrust which allows operation up to one hour of continuous use. Typically each motor will produce at maximum power about twenty-four to one-hundred-one pounds of thrust or more.

The device runs smoothly and quietly in the water. The headlight is designed with a particular safety feature. For example, if one is night diving and the light should burn out, the operator can simply move the switch to the opposite position and the second beam will be in operation. This prevents one from being "left in the dark".

The device can optionally include a eyebolt (not shown in the drawings), attached to the body 18 or control assembly 16, which is ideally located for towing a vehicle or another diver. It can also be used as a tether to the operator's belt to prevent the unit from floating to the surface because of it's positive buoyancy. Buoyancy of the unit can be varied by adding ballast weight inside the body 18 or inside a tube 26 under the body 18 to the desired buoyancy.

Of course, any of the specifications in the above embodiment may be amended or modified as necessary for the particular application. For example, different batteries, lights or switches may be better adapted to specific situations.

Figure 2:
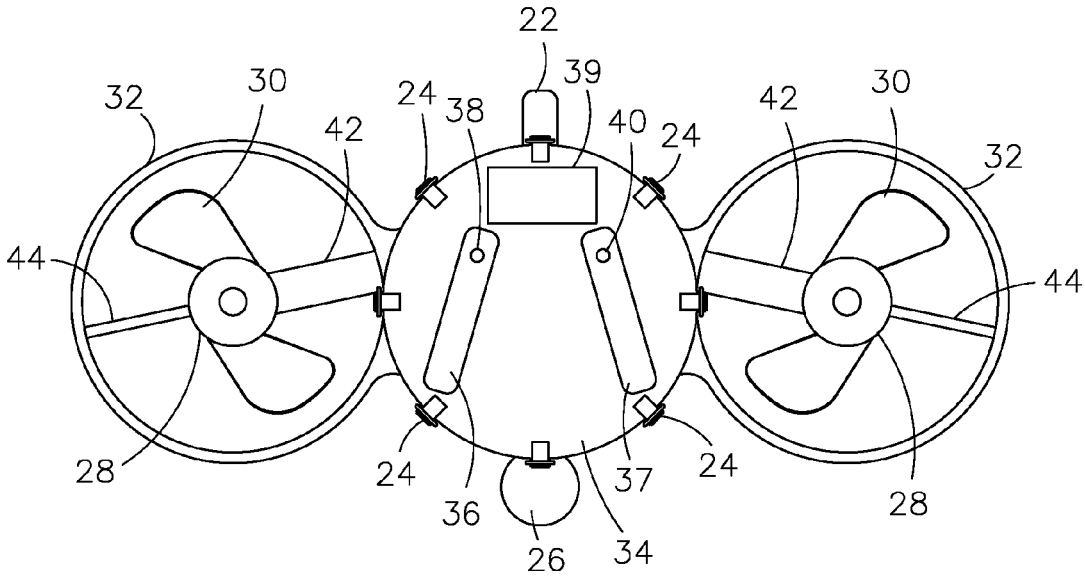
FIG. 2 shows an elevation view of the rear of the invention.

Referring back to the drawings, where an important version of the present invention is shown in FIGS. 1 and 2 and generally referred to with numeral 10, it can be observed that it basically includes a body assembly 12, a pair of thruster assemblies 14 and a control assembly 16.

The body assembly further includes, inter alia, a body 18, a nosecone 20, a handle 22, multiple latches 24 and a ballast tube 26.

Each of the thruster assemblies 14 are essentially mirror images of each other and each further comprise, inter alia, a motor 28, a propeller 30, a shroud 32, a strut 42 and a support 44.

The control assembly 16 is shown to include, inter alia, a hatch 34, a handle 36, a handle 37, a switch 38, a display 39 and a throttle 40

Still referring to FIGS. 1 and 2, the body assembly 12 is the central structure and largest part of the device. The body 18 is generally a hollow cylinder that contains the several internal components and provides the structure onto which the other necessary and optional components are affixed. The handle 22 is provided on most variations to more easily transport the device while not in the water.

To each side of the body assembly 12 is affixed a motor 28. The motor 28 connects to the body 18 via a strut 42. The strut 42 is generally a tube that holds the motor 28 the proper distance away from the body assembly 12 to prevent the propeller 30 that is powered by the motor 28 from hitting the body assembly 12. As is described in more detail below, the strut 42 also acts as a conduit for wiring that supplies power to the motors 28.

The motor 28 is, in some variations of the invention, also supported by a support between the motor 28 and the inside of the shroud 32. If the support 44 is not present in any given variation, then the entire weight of the motor 28 and the force that it produces in combination with the propeller 30 is borne by the strut 42.

Preferably, the strut 42 and the support 44 are constructed of a rigid and durable material such as aluminum, stainless steel or a composite material such as fiberglass, carbon fiber or para-aramid based material. The strut 42 and support 44 may be made of the same material as that of the shrouds 32 so that they are fully integrated in form and construction to improve strength of the connection between these elements and also aid in construction techniques.

The strut 42 and support 44 may be cylindrical in cross-section or may also take the form of a hydrodynamic foil to track truer while the vehicle is in motion. The hydrodynamic cross-section can act similar to an aircraft wing to provide lift and tracking. The hydrodynamic shape of the cross-section can also have neutral lift if shaped similar to a symmetrical tear drop. The cross-section shape can reduce the fluid resistance experienced by the strut 42 and support 44 thereby allowing the device to move easier through the water resulting in faster speeds and/or reduced battery usage.

The shrouds 32 are affixed, one each, to the left and right side of the body 18. The shrouds 32 each house a propeller 30 that is connected to a motor 28. The shrouds 32 aid in preventing any foreign object, or an operator of the vehicle, from contacting the propeller 30. This protects both the propeller 30 and the operator from injury.

The shrouds 32 also act to direct the flow of water that the propellers 30 push when in operation. This feature avoids the otherwise necessary stabilizing fins or struts. In typical use, water is drawn into the front of the shroud 32 by the propeller 30 and forced out of the back of the shroud 32 in a directed flow of water. The shroud 32 acts to expel that flow of water in the most efficient way behind the device. In this way the prop-wash behind the vehicle avoids interacting with the user of the device.

It is important for an operator of the device to not be directly in the prop-wash, flow of water ejected by the propellers 30. The efficiency of the vehicle is potentially adversely affected if the force of water flow created by the propellers 30 strikes or is obstructed by the operator. It is important to have a free path of fluid travel behind the propeller or efficiency can be severely compromised.

Besides efficiency, the operator coming into contact with the prop-wash can make it more difficult to hold on to the device. This can prematurely fatigue the operator resulting in a dangerous condition made worse by being underwater. Further, the prop-wash can blow off the operator's dive mask or breathing regulator, also a very dangerous condition for the operator.

Figure 9:
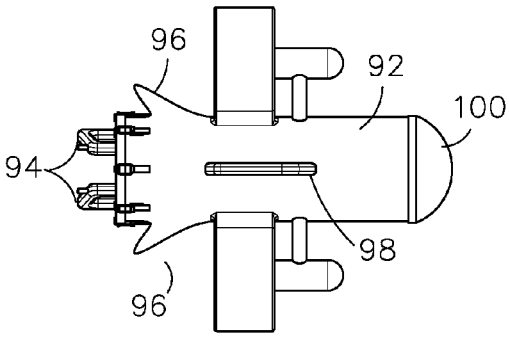
FIG. 9 shows a plan view of an alternate form the present invention.

Now referring to FIG. 9 where an alternate solution to the prop-wash issue is demonstrated to include, inter alia, a body, 92, handles 94, a fairing 96, a handle 98 and a nosecone 100.

The feature most distinguishing in this figure are the fairings 96 on both the left and right side of the body 92. The fairings 96 are positioned behind the line of thrust of the propellers and act to deflect the prop-wash away from the operator. In this embodiment the nosecone 100 is the first point where the device pushes through the water beginning the separation of water flow around the device. Water is then drawn into the shrouds and pushed into the fairings 96 where the flow of water is directed away from the operator.

This takes pressure from the prop-wash off of the operator who can then more easily hang onto handles 94. In a version of the device the fairings 96 are removable when not desired. In another version, the fairings 96 are integrated into the body 92 of the device and seamlessly protrude from the aft sides of the device and are made of the same material as that of the body 92.

Figure 10:
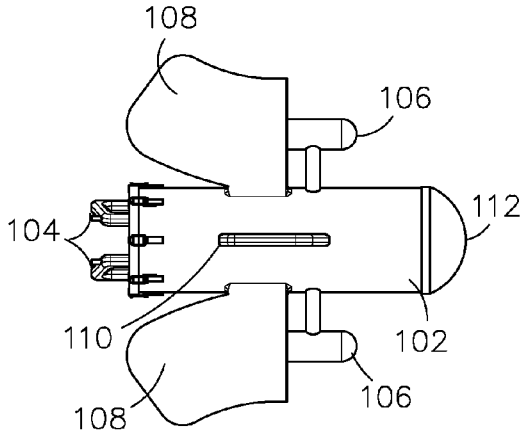
FIG. 10 shows a plan view of yet another form of the present invention.

FIG. 10 is another alternate solution to avoiding prop-wash effects on the operator and includes, inter alia, a body 102, handles 104, motors 106, a thrust directors 108, a handle 110, and a nosecone 112. In this version the motors 106 are inside the fore end of the thrust directors 108. The water propelled by the propellers enters the fore end of the thrust directors 108 and is expelled from the aft end of the thrust directors 108 at a predetermined angle slightly away from where the operator holds onto handles 104.

In alternate variations of this design the thrust director 108 can be an attachment to the shroud 32 as is shown in FIG. 1. In another version the thrust director 108 is a unified element from fore of the motor 106 to aft of the propeller and is integral to the side of the body 102. Similar to the other versions of the device, the nosecone 112 is the first element to begin to split the oncoming water that works in concert with the thrust directors 108 to control the flow of water as the vehicle moves forward to maintain a streamline flow and also to avoid the flow of water over the vehicle from interacting with the operator.

Referring again to FIGS. 1 and 2 where the body assembly 12 is shown to be essentially a cylinder and it is capped at an aft end with a hatch 34 and a nosecone 20 on a fore end.

An important option is to have a frangible seal holding the nosecone 20 onto the body assembly 12. This allows a relief means should the interior of the body assembly become over-pressured. The frangible seal would prevent operator injury. Additionally or alternatively, the latches 24 around the periphery of the hatch 34 may include some give prior to failure in the case of over-pressure inside the body assembly 12. In some designs it may be preferred to have the latches 24 give to vent pressure from the body assembly 12 to allow a means to drain water from the inside. For example, a small pressure injection into the body assembly 12 could force water out of the seal between the body assembly and the hatch 34 somewhat similar to how a diver may clear her mask while at depth by introducing pressure to the inside of the mask forcing water to drain out the bottom edge of the mask.

Figure 4:
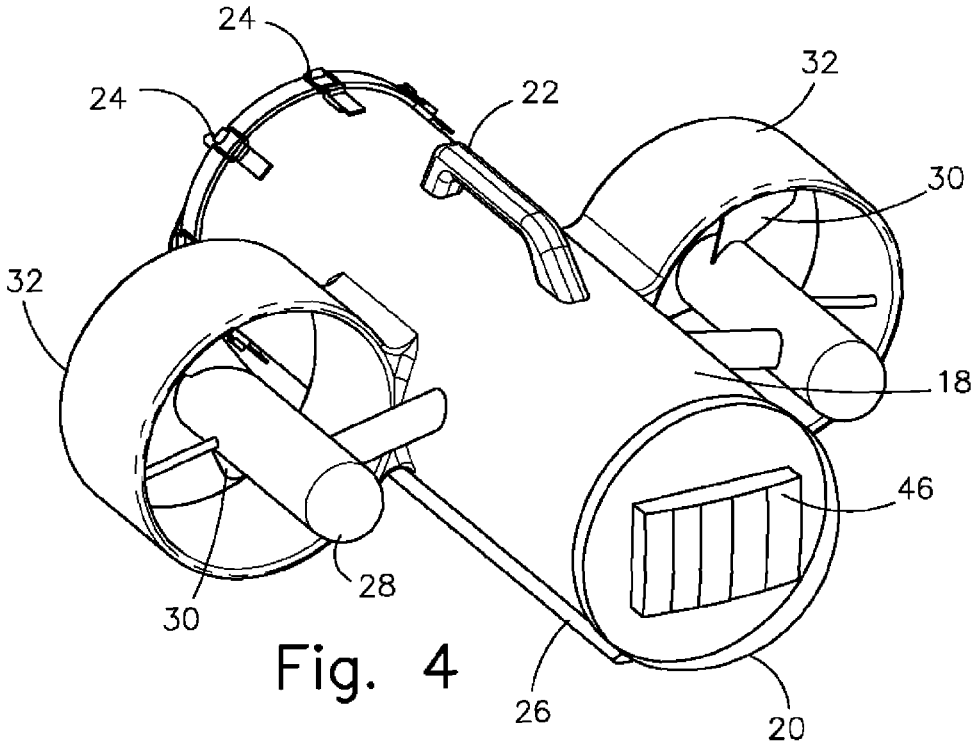
FIG. 4 is a representation of a perspective view of the device from a right-front side.

Referring to FIG. 4, a front perspective view of the device is shown. The nosecone 20 is generally a dome that encloses the fore end of the body assembly. In a preferred version, the nosecone 20 is made a clear, rigid material such as glass, acrylic or other plastic. Under the nosecone 20 is a light 46. The nosecone 20 is preferably permanently affixed to the fore end of the body assembly 12. Access to the light 46 for service and maintenance purposes may be had through the hatch 34 on the aft end of the body assembly 12.

In other versions the light 46 may be absent from the device and the nosecone 20 may then be absent or constructed of a rigid, opaque material. Without a light 46 the nosecone 20 may be integral to the construction of the body 18 of the body assembly 12. Whether a light 46 is present or not, the nosecone 20 preferably is formed of a hydrodynamic shape so that the energy required to propel the vehicle through the water is minimized, speed is optimized and the required battery weight to complete a particular application is minimized.

The light 46 may be controlled by switch 38. The switch 38 can simply be comprised of an on-off switch or may index through incremental intensities of the light. For example, when the light 46 is off a single push of switch 38 turns the light 46 on to a low intensity, a second push turns it to a medium intensity, a third turns the light 46 on high intensity and a subsequent push turns the light 46 off. Alternatively, a half-press of switch 38 may result in a low light 46 intensity and a full press of switch 38 results in full light 46 intensity.

In another preferred version of the light 46, it comprises a multiple filament lamp, similar to an automobile low-beam and high-beam configuration. The switch 38 when pressed once turns on a first filament and when pressed again also illuminates a second filament thereby producing a stronger beam of light. By this means, if one of the filaments is broken, or 'burns out', another filament remains to produce some degree of illumination. This means of a redundant light system or back-up can increase the safety of the vehicle.

Still referring to FIGS. 1 and 2 where the control assembly 16 is shown to comprise the aft side of the vehicle. The hatch 34 encloses the aft end of the body assembly 12 by sealing against the body 18. The hatch 34 is removably held against the body 18 by means of multiple latches 24. The latches 24 are comprised of two elements each, one of the hatch 34 and the other element on the body 18. A series of latches 24 around the periphery of the aft end of the body 18 and corresponding elements around the periphery of the hatch 34, hold the hatch 34 tightly against the body 18. Preferably there is also a gasket between the hatch 34 and the body 18 to ensure no water leaks inside the body assembly 12, particularly when the vehicle is under pressure at depth.

The control assembly 16 also includes handle 36 and handle 37 that are used by the operator to hang on to the device. The handles 36 and 37 are dimensioned to be grasped by a human hand. Preferably the handles 36 and 37 are made of a rigid and durable material. Switch 38 is positioned on handle 38 where it can be operated by the users thumb. Throttle 40 is provided on the handle 37 to control the operation of the motors 28 with the users thumb.

The throttle 37 may be a magnetic switch which can avoid corrosion or other failure issues associated with other types of controls. The throttle 37 may be a fully variable voltage throttle so that by pushing it a little the vehicle moves slowly, conserving energy. And, by progressively pressing the throttle more forcefully, more power is applied to the motors 28 causing the vehicle to accelerate and propel forward at a higher rate of speed through the water.

A preferred version of the control assembly 16 orients the handles 36 and 37 closer together at the upper side of the handles 36 and 37 so that they may grasped together by one hand of the operator. This may be useful if, for example, the operator is injured or otherwise requires use of one hand. The tops of the handles 36 and 37 are close enough that one hand can grasp both handles 36 and 37 and yet be able to operate the throttle 40 to control the vehicle.

The motors 28 are the main producers of thrust but can be supplemented by the operators swimming behind the device. The motors are preferably oil-filled to prevent the intrusion of water, particularly at higher pressures, and extend the life of the motor 28.

Either directly connected to each motor 28 or through a gear box is a propeller 30. Various pitches and diameters of propellers 30 may be best paired with a particular combination of a battery 48, motor 28 and gear box (if present). Propellers 30 with two, three, four or more blades may also be varied, again depending on the means and mechanism employed to power the propeller. The weight of the vehicle, range and expected tow capacity will also affect propeller selection.

The hatch 34 may be constructed of a transparent material, such as acrylic or other synthetic material, so that the contents of the body assembly 12 may be readily visible. This feature provides a quick status check to ensure that water has not breached the interior of the body assembly 12 and compromised the reliability and functionality of the vehicle.

Figure 11:
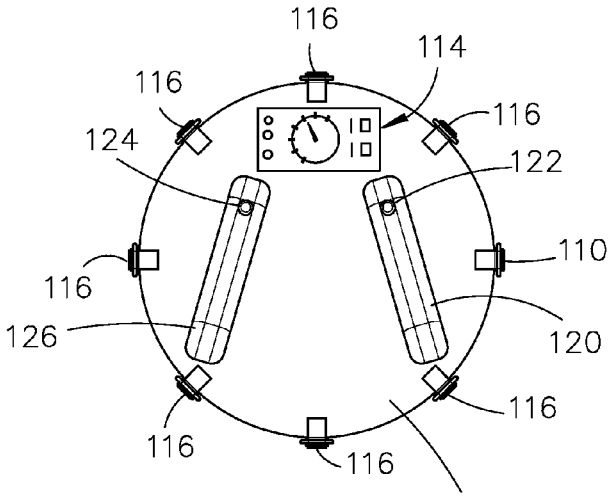
FIG. 11 is a plan view of a close up of a hatch as could be used with any version of the device.

Optionally, a display 39 may be present on the hatch 34 to provide feedback information to the operator of the vehicle. A detailed view of a preferred version of a hatch 118 is shown in FIG. 11 and includes, inter alia, a display assembly 114, latches 116, a handle 120, a throttle 122, a button 124 and a handle 126.

The display assembly 114 may have a variety of gauges and information displays to provide the operator essential information. The position of the display assembly 114 is essentially a heads-up-display allowing the operator to steal glances at the display assembly 114 without moving their head which allows the operator to maintain visual contact out front for the navigation of the vehicle.

Examples of the content viewable on the display assembly 14 is provided merely as a possible configuration and may change from time to time as the components and accessories used with the vehicle and diver may advance. However, it is presently anticipated that the display assembly 114 may show the battery reserve power remaining, the status of battery charging operations, time, time elapsed, distance traveled, compass heading, depth, time submerged, global positioning system (GPS) maps, cartography, bathymetry or other information relevant to the operator and her mission.

In a preferred variety of the vehicle the display assembly 114 may connect wirelessly to the operators dive equipment. This can perform similar to a dive computer uses by the operator while underwater to calculate dive tables, estimate air time remaining, decompression stops, air pressure remaining in the operator's tanks and any other information useful to the operator while diving.

Tube 26, shown in FIGS. 1 and 2, is provided optionally if additional volume of space is beneficial to adjust the buoyancy of the device. The tube 26 if present, is generally a hollow cylinder that is sealed at both ends to contain air at atmospheric pressure.

Tube 26 can alternatively be used to provide a storage space for mission essential equipment such as a spear gun or dive flag. In this configuration the aft end of the tube 26 may include a threaded cap or simply be open to the sea. In some cases a ballast weight may be included in the tube 26 to aid in righting the vehicle similar to ship's ballast in the keel.

Figure 12:
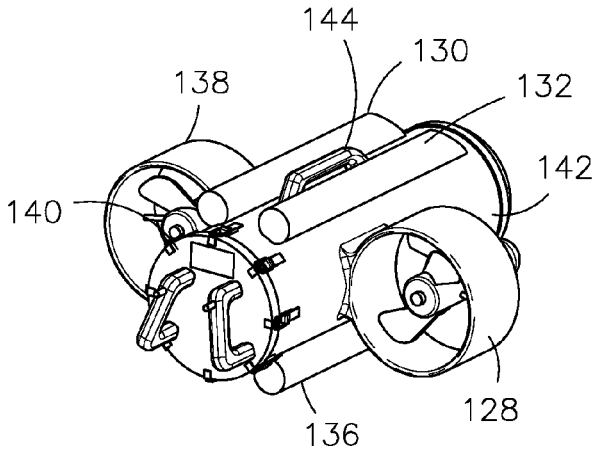
FIG. 12 is a perspective view of a version of the device from the right rear.
Figure 13:
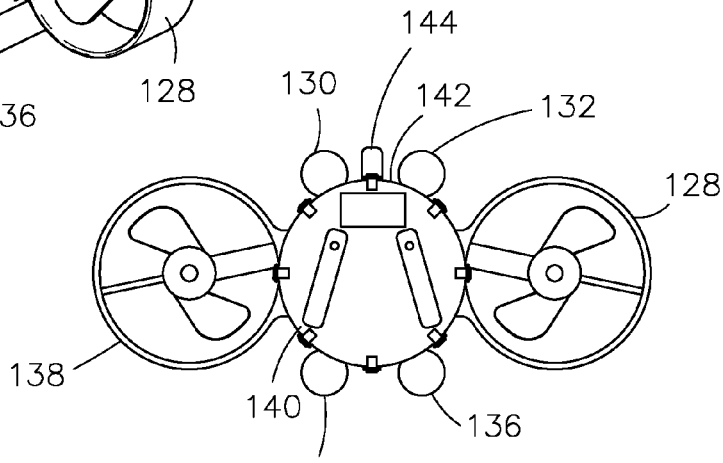
FIG. 13 is an elevation view of the device similar to that shown in FIG. 12.

FIGS. 12 and 13 show a version of the vehicle to include optional features and required features including, inter alia, a shroud 128, a tube 130, a tube 132, a tube 134, a tube 136, a shroud 138, a hatch 140, a body 142 and a handle 144.

The tube 130 and tube 132 are shown on the top side of the body 142 of the vehicle. Tubes 130 and 132 are hollow and filled with air and are optionally available to provide additional buoyancy. For some application the net mass of the device may be increased by additional equipment carried on or in the vehicle such as, additional batteries, cameras, lights or the like. To maintain a slight positive buoyancy of this extra equipment a hollow volume is attached to the vehicle in the form of tubes 130 and 132. To keep the device balanced to the left and right both tubes 130 and 132, if present, should be both attached to the top of the body 142 to the left and right of the handle 144.

In most applications the volume of tubes 130 and 132 are preselected before the device is deployed into the water, to compensate for any extra equipment. In this situation the tubes 130 and 132 are preferably rigid cylinders likely constructed of a similar material to that of the body 142. Removable fasteners are provided to allow the easy adding and removal of these tubes 130 and 132.

In some applications it may be desirable to have tubes 130 and 132 constructed of an inflatable material that can be inflated and deflated to a desired volume that provides a selected amount of buoyancy. In another variation, the tubes 130 and 132 are open ended on the aft end so that they can act as storage cylinders for devices such as a spear gun, dive flag, weapon or other needs depending on the application of the vehicle and the mission.

Tubes 134 and 136 are optionally located beneath the body 142 and similar to tubes 130 and 132 they can provide added buoyancy or extra storage capacity. Due to imbalancing the lift profile, tubes 134 and 136 are generally not used for buoyancy purposes if tubes 130 and 132 are not simultaneously used as buoyancy aids. However, tubes 130 and 132 may be readily used as storage means regardless of whether tubes 130 and 132 are present.

Figure 3:
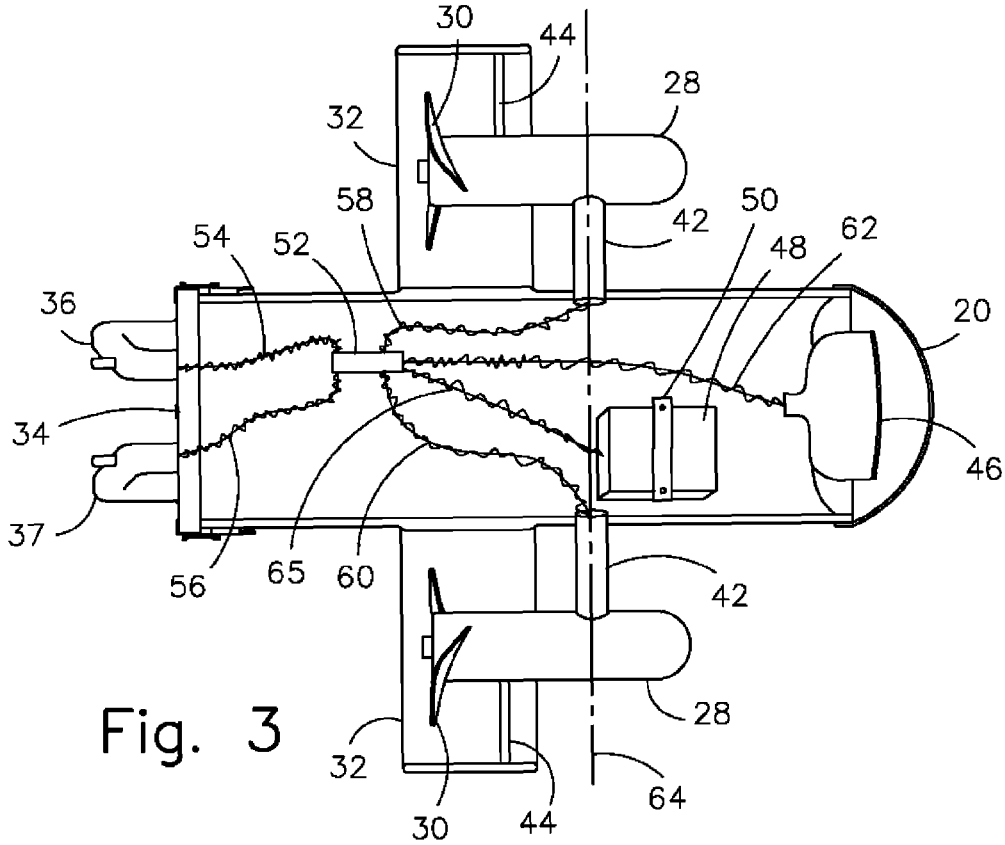
FIG. 3 illustrates plan view cross-section of the device demonstrating the internal components.

Now referring to FIG. 3 where a cross-section view s shown to demonstrate an example of how the device may be electronically configured to include, inter alia, a light 46, a battery 48, a strap 50, a busbar 52, a cable 54, a cable 56, a cable 58, a cable 60, a cable 62 and a cable 65. A center line 64 is also shown.

Generally, the device shown in FIG. 3 is similar in material respects to the device as shown in FIGS. 1 and 2. One or more batteries 48 are affixed to the interior of the body 18 by a strap 50 or other suitable securing means. Because the vehicle may experience turbulence or be turned up-side down occasionally the batteries 48 must be securely fastened to the body 18.

The busbar 52 is provided to distribute the battery's 48 power to the light 46 and the motors 28. The switch 38 controls the operation of the light 46 and the throttle 40 controls the power that is supplied to the motors 28. Preferably, each of the connections between each of the components and the cables 54, 56, 58, 60 and 62 are sealed and watertight to avoid corrosion and short circuits.

The location of the battery 48 inside the body 18 is important for balance of the vehicle as a whole. The battery 48 is generally one of the heavier components of the device and can affect the pitch bias of the device in motion when limited control inputs are applied by the operator through the handles 36 and 37. It is easier for an operator to simply be towed by the device rather than to have to force the device to track in a particular path. In this sense, shifting where the weight of the battery 48 is inside the body 18 acts to trim the vehicle for easy, straight and level travel without substantial corrective input from the operator.

Differing battery 48 chemistries have been contemplated to include categories such as lead-acid, saturation, gel, sealed, wet cell, dry cell, nickel metal hydride, lithium ion or a fuel cell. However, any compact and rechargeable technology as may become available from time to time may be substituted.

Once trimmed and balanced, the ability to steer and control the device is further enhanced by the center of thrust of the motors 28 being on or slightly forward of the net center of gravity of the vehicle. The center line 64 is an exemplary position of the net center of thrust provided by the motors 28 and propellers 30. When the center of thrust center line 64 is at or slightly forward of the net center of mass of the vehicle as a whole then the vehicle exhibits docile steering and control characteristics. This allows the operator to impart relatively light control inputs which reduces strain and fatigue on the operator.

As well as being balanced in both mass and thrust, the buoyancy should also be slightly positive. The buoyancy can be altered both by adding hollow volume, such as by tubes 26, 130, 132, 134 and 136 (or a combination thereof as described, supra), by changing the weight carried inside the body assembly 12 or by adding ballast weight. If a ballast weight is used it is important from a safety standpoint to allow some means of quick release of the added weight from the device so that in the case of an emergency the added encumbrance can be shed and the vehicle and operator can be more easily raised to the surface, even if the motors 28 are not fully operational.

Experimentation and experience has shown that for fresh water operations the optimal buoyancy is approximately one pound of lift and for salt water approximately one and a half pounds of lift. For varying salinity and depth conditions. These values are merely guidelines and depending on the operator, the mission, safety, the accessories used and the environment, the amount of buoyant lift may be adjusted more or less as appropriate.

Figure 5:
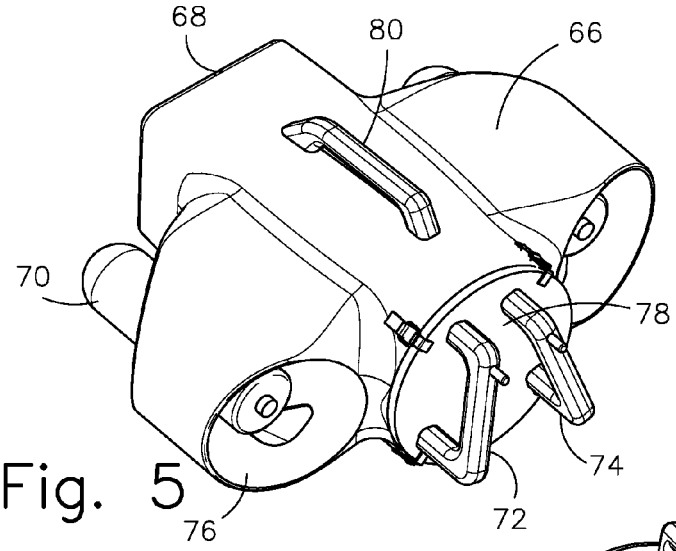
FIG. 5 shows a perspective rear-left view of an alternate version of the invention.
Figure 6:
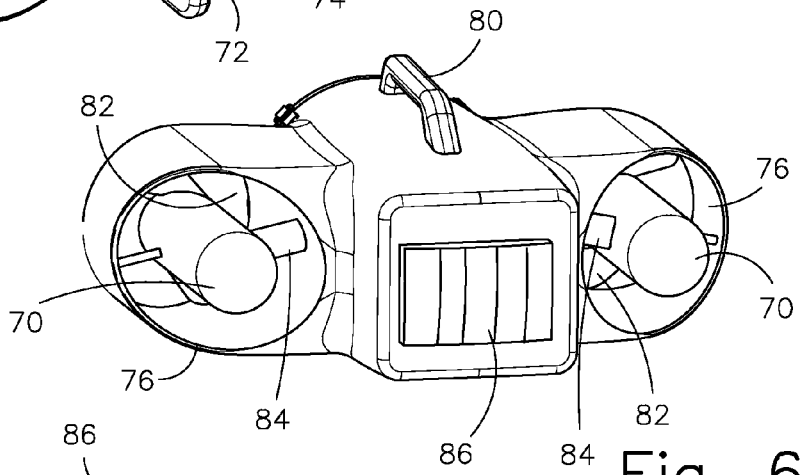
FIG. 6 is a perspective view from the front of the example of the device shown in FIG. 5.
Figure 7:
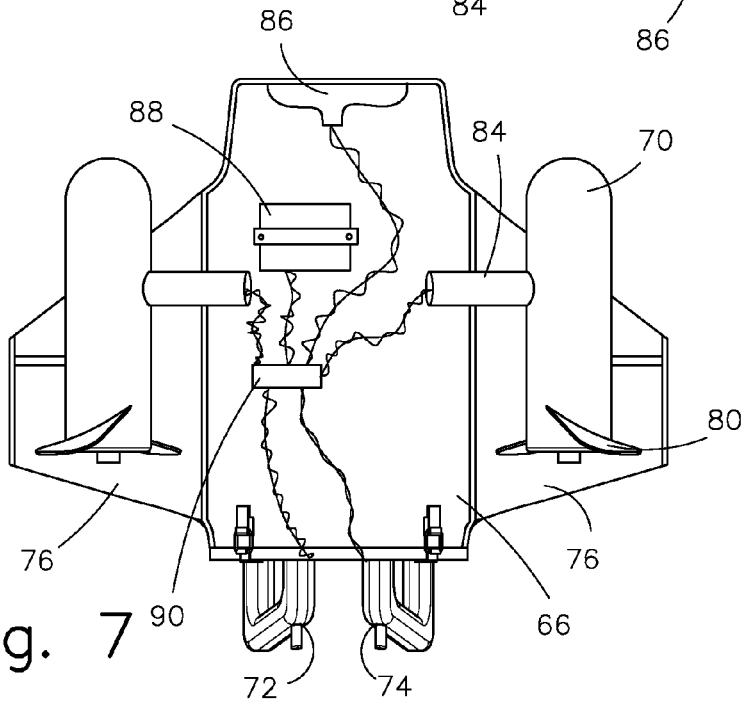
FIG. 7 is a plan view cross-section of the device as exemplified in FIG. 5 demonstrating the interior components.
Figure 8:
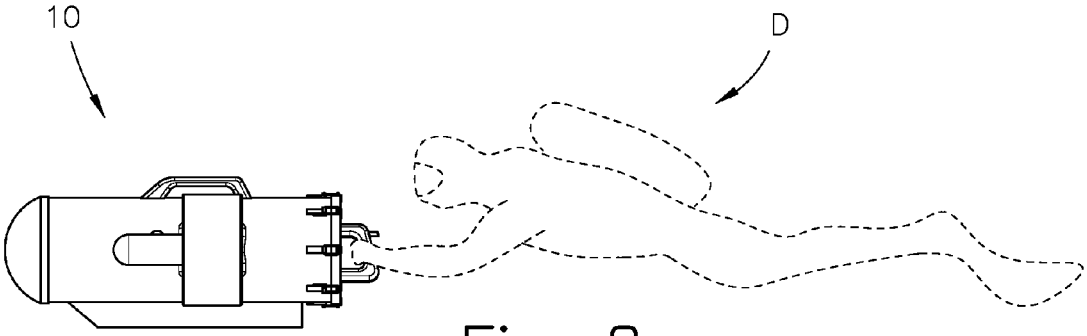
FIG. 8 is an elevation view of an example of a human diver using the device.

Now referring to FIGS. 5, 6 and 7 where an alternate form factor of the vehicle is demonstrated in several views to be comprised of, inter alia, a body 66, a nosecone 68, a motor 70, a handle 72, a handle 74, a tube 76, a hatch 78, a handle 80, propellers 82, struts 84, a light 86, a battery 88 and a busbar 90.

The most important difference between the vehicle as shown in FIGS. 1 and 2 and that shown in FIGS. 5, 6 and 7 is the exterior shape of the body 66. Regardless of whether the shape of the body assembly 12 or body 66 is cylindrical or not, it is important that the body 66 has sufficient interior volume to displace enough water to provide a slightly net positive buoyancy for the vehicle.

Generally, the more streamlined the shape of the body 66 and how well it hydrodynamically encases the motors 70 then the more efficient the device can be. This results in a smaller battery 88, being able to power smaller motors 70 and smaller propellers 82 while being able to carry a substantial load at high speed for a sufficient distance.

The shape of the body 66 shown in FIGS. 5 and 6 allow the water to smoothly flow over the body 66 and avoids the propeller wash from impacting the operator as she holds onto handles 72 and 74, similarly to other variations of the device.

Controls are provided to operate the light 86 and the throttle that controls the current supplied to the motors 70 which directly affects battery life, range and speed of the vehicle. The counter-rotating propellers 82 in combination with the tubes 76 that contain the propellers 82 act in concert to create a directed flow of water ejected from the aft of the vehicle during forward motion. The counter rotating propellers 82 are applicable to any version of the device and a preferably present to allow the vehicle to track true and avoid the necessity of any fins or other stabilizing means to avoid the torque effects that can tend to roll or steer the device off course during operations.

An optional feature not shown in the drawings is a grate that is placed in front of and/or behind both of the shrouds 32 to prevent foreign objects, or the diver's hands from striking the propeller and causing injury to the operator and the vehicle. A grate, if present, will allow water to easily flow into the shrouds 32 yet still prevent intrusion of unwanted objects.

An example of the electrical components are shown in more detail in FIG. 7 where a busbar 90 connects the power supplied to the motors 70 and light 86 from the battery 88. The operator can easily access controls with either both hands on the handles 72 and 72 or with a single hand. This allows the operator to remain in control of the vehicle while injured or while using one hand for other purposes, such as to hold onto another diver while in operation of the vehicle.

Figure 14:
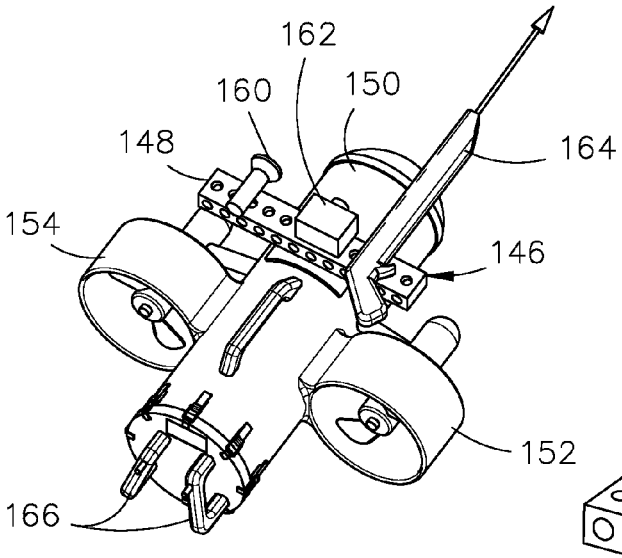
FIG. 14 is a perspective view of a version of the device including an optional accessory rack.
Figure 15:
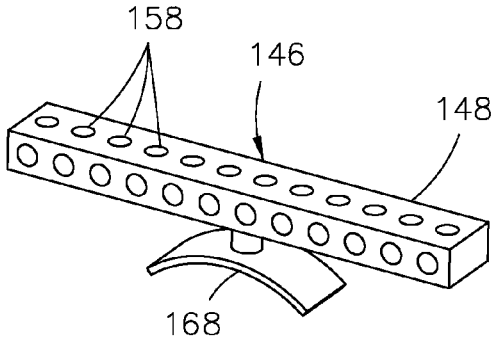
FIG. 15 is a perspective view of an accessory rack.

Now referring to FIGS. 14 and 15 where an accessory device is shown on a version of the vehicle to include, inter alia, a mount assembly 146, a bar 148, a body 150, a shroud 152, a handle 156, apertures 158, a light 160, a camera 162, a spear gun 164, handles 166 and a plate 168. Other versions of the device described supra show and explain analogous features seen on multiple versions of the vehicle.

The mount assembly 146 is an optional feature that can be used to affix accessories to the exterior of the device that may be needed for completion of a particular mission. It generally is comprised of a plate 168 that attaches to the exterior top side of the body 150. Equally another form of mount assembly may be attached to the handle 156 on the top of the device or on the body 150 on the bottom side or on the top side of the body 150 aft of the handle 156.

While attached to the body 150, other devices that may be useful to the operator, can be removably affixed to the mount assembly 146 for easy access and deployment. The example in FIG. 14 show but a few possibilities that include a supplemental light 160, a camera 162 and a spear gun 164.

A series of apertures 158 on the bar 148 allow for a universal mount for other accessories. Other devices such as a global positioning (GPS) antenna, dive knife, survival gear or other mission critical gear may be affixed as needed.

Preferably, the mount assembly 146 itself may be removed if not in use for a particular application. The mount assembly 146 could equally be permanently affixed to the body 150 with good results. The mount assembly 146 is preferably constructed of a rigid, durable and corrosion resistant material such as aluminum, plastics, fiberglass, or other synthetic materials or alloys.

The invention can be fairly characterized as an underwater personal vehicle having a body assembly, a first and a second thruster assembly and a control assembly. The body, generally hollow except for the interior components, has a left side, a right side, fore side, an aft side, a top side, a bottom side similar in perspective to other nautical vessels. An imaginary first axis spans between the center of said fore side and the center of said aft side which is generally amidship in about the middle one third of the body. This center line is approximately from where the force of thrust from the motors effectively pushes the vehicle. This balances the forces effecting the vehicle making it easy to steer and control dives. The body contains a rechargeable battery or batteries, as the mission requires. The body is preferably comprised of a sealed, hollow body made of a rigid material, having a displacement equal to or greater than the net weight of said vehicle. The body may be made of, for example, a plastic, metal, composite or reinforced material such as para-aramids or fiberglass type material. To said left side of the body at about an amidship is affixed said first thruster assembly and to said right side of the body at about said amidship is affixed said second thruster assembly. The thrusters are connected to the body at approximately the center of the vehicle measured from front to back and this is where the center of thrust is experienced by the vehicle. Each of said first and second thruster assemblies further includes an electric motor coupled to a propeller where said propeller is encircled by a shroud to provide the propulsion force. Each of said thruster assemblies are adapted to direct a thrust substantially parallel to said first axis or generally behind the vehicle when moving forward and to the front of the vehicle if moving in reverse. Each of said shrouds has a substantially tubular interior having a diameter dimensioned to house said propeller. The propeller must fit nearly snugly inside the shroud to avoid slippage but the propeller should never contact the inside of the shroud. The body assembly optionally has a light covered by a transparent nosecone on said fore side of said body. The light shines through and is protected by the nosecone. The control assembly is integral to said aft side of said body and includes a first handle and a second handle, both affixed to a removable hatch. The first handle further having a switch operably coupled to said battery and said light. The second handle further has a throttle operably coupled between said electric motors and said battery. The handles may be nearer together at the top of the vehicle to allow for one handed operations if necessary.

Several optional configurations are contemplated including in that said throttle is a continuously variable speed throttle, an accessory bar adapted to attach accessories is affixed to said top side of said body such as another light, a spear gun or a camera, to name a few possibilities. Also, the body at the top side can include a carry handle adapted to carry the vehicle when not in the water. To increase the reliability of the thruster assemblies each of said electric motors and the coupled gearing can be oil filled. This prevents water intrusion and lubricates the device. To properly trim, balance and weight the vehicle an attachment point for a ballast weight is optionally included, preferably on said bottom side of said body adapted so that the ballast weight may be affixed to the bottom of the body at any point between the fore and aft of said body effectively allowing for balancing the vehicle for trim and level operation. For safety a fairing is optionally included to an aft side of said thruster assemblies on each of said right side and said left side of said body adapted to deflect said thrust away from said first axis. This can keep the operators dive mask from inadvertently blowing off her face. For greater functionality a control assembly includes a display that is adapted to display any combination of a global positioning system map, a compass, a distance traveled, a battery power remaining, a light status, a battery charging status, a speed, a diver air status, a depth gauge or other information that may be of interest to the operator. To prevent an over-pressure failure event the seal that connects the nosecone to the fore side of said body adapted so that said seal breaches at a predetermined pressure inside said body. To stabilize the vehicle said propellers are counter-rotating. A protective grate covers a fore side and an aft side of said shrouds to further enhance safety in another version of the vehicle. In yet another version between one and five supplemental buoyancy tubes are affixed to the body at strategic locations to balance the vehicle and provide additional lift, for example if multiple, heavy batteries are employed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An underwater personal vehicle comprised of a body assembly, a first and a second thruster assembly and a control assembly;

said body having a left side, a right side, fore side, an aft side, a top side, a bottom side and a first axis between the center of said fore side and the center of said aft side;

said body containing a rechargeable battery;

said body assembly further comprised of a sealed, hollow body made of a rigid material having a displacement greater than the net weight of said vehicle so that the vehicle is buoyant;

to said left side of the body at about an amidship is affixed said first thruster assembly;

to said right side of the body at about said amidship is affixed said second thruster assembly;

each of said first and second thruster assemblies further includes an electric motor coupled to a propeller where said propeller is encircled by a shroud;

each of said thruster assemblies are fixed relative to the body to only direct a thrust substantially parallel to said first axis;

each of said shrouds has a substantially tubular interior having a diameter dimensioned to house said propeller;

said body assembly having a light covered by a transparent nosecone on said fore side of said body;

said control assembly is integral to said aft side of said body and includes a first handle and a second handle each affixed to said aft side of said body such that an operator of the vehicle is pulled directly behind the body and between said thrusts from each of said thruster assemblies;

said first handle further having a switch operably coupled to said battery and said light;

said second handle further having a throttle operably coupled between said electric motors and said battery.

2. An underwater personal vehicle as disclosed in claim 1, further characterized in that said throttle is a continuously variable speed throttle.

3. An underwater personal vehicle as disclosed in claim 1, further characterized in that an accessory bar adapted to attach accessories is affixed to said top side of said body.

4. An underwater personal vehicle as disclosed in claim 1, further characterized in that said body at said top side includes a carry handle that is fixed in position relative to the body.

5. An underwater personal vehicle as disclosed in claim 1, further characterized in that each of said electric motors is oil filled.

6. An underwater personal vehicle as disclosed in claim 1, further characterized in that an attachment point with an emergency release for a ballast weight is included on said bottom side of said body adapted so that the ballast weight may be affixed to the bottom of the body at any point between the fore and aft of said body effectively allowing for balancing the vehicle for trim and level operation.

7. An underwater personal vehicle as disclosed in claim 1, further characterized in that a fairing is included to an aft side of said thruster assemblies on each of said right side and said left side of said body that deflect said thrust away from said first axis and away from an operator being pulled by the underwater personal vehicle.

8. An underwater personal vehicle as disclosed in claim 1, further characterized in that on said control assembly is provided a display that is adapted to display any combination of a global positioning system map, a compass, a distance traveled, a battery power remaining, a light status, a battery charging status, a speed, a diver air status and a depth gauge.

9. An underwater personal vehicle as disclosed in claim 1, further characterized in that a frangible seal connects said nosecone to said fore side of said body adapted so that said seal breaches at a predetermined pressure inside said body thereby relieving an over-pressure inside the body during operation.

10. An underwater personal vehicle as disclosed in claim 1, further characterized in that said propellers are counter-rotating.

11. An underwater personal vehicle as disclosed in claim 1, further characterized in that a protective grate covers a fore side and an aft side of said shrouds.

12. An underwater personal vehicle as disclosed in claim 1, further characterized in that between one and five supplemental buoyancy tubes are affixed externally to the body.

* * * * *